US005225097A

United States Patent [19]

Kacher et al.

[11] Patent Number: 5,225,097

[45] Date of Patent: Jul. 6, 1993

[54] SKIN PH FREEZER BAR AND PROCESS

[75] Inventors: Mark L. Kacher, Mason; James E. Taneri, West Chester; Diane G. Schmidt; Teresa K. Wong, both of Cincinnati, all of Ohio

[73] Assignee: The Procter & Gamble Company, Cincinnati, Ohio

[21] Appl. No.: 854,927

[22] Filed: Mar. 20, 1992

[51] Int. Cl.[5] ..... C11D 9/48; C11D 10/04; C11D 13/12; C11D 13/18

[52] U.S. Cl. ..... 252/112; 252/108; 252/109; 252/110; 252/111; 252/113; 252/117; 252/118; 252/121; 252/122; 252/131; 252/134; 252/174; 252/368; 252/370; 252/554; 252/557; 252/DIG. 5; 252/DIG. 12

[58] Field of Search ..... 252/108, 109, 110, 111, 252/117, 118, 121, 122, 131, 132, 134, 174, 367, 368, 369, 370, 554, 557, DIG. 5, DIG. 16

[56] References Cited

U.S. PATENT DOCUMENTS

| | | | |
|---|---|---|---|
| 2,826,551 | 3/1958 | Geen | 252/89 |
| 2,988,511 | 6/1961 | Mills et al. | 252/121 |
| 2,988,551 | 6/1961 | Morren | 260/268 |
| 3,351,558 | 11/1967 | Zimmerer | 252/137 |
| 3,557,006 | 1/1971 | Ferrara et al. | 252/117 |
| 3,835,058 | 9/1974 | White | 252/121 |
| 3,835,059 | 9/1974 | Fukuta et al. | 252/305 |
| 4,234,446 | 11/1980 | Morshauser | 252/544 |
| 4,606,839 | 8/1986 | Harding | 252/132 |
| 4,673,525 | 6/1987 | Small et al. | 252/132 |
| 4,704,223 | 11/1987 | Gupta et al. | 252/132 |

FOREIGN PATENT DOCUMENTS

| | | |
|---|---|---|
| 57-61800 | 12/1982 | Japan . |
| 60-23156 | 6/1985 | Japan . |
| 513696 | 10/1938 | United Kingdom . |

*Primary Examiner*—Dennis Albrecht
*Attorney, Agent, or Firm*—Leonard Williamson

[57] ABSTRACT

The invention provides a firm, low smear, ultra mild, weakly acidic skin pH (4.8–6.0) personal cleansing freezer bar comprising by weight of said bar: a sum total of from about 10% to about 50% of essentially free carboxylic acid, preferably myristic acid, behenic acid, or 12-hydroxy stearic acid; from about 15% to about 65% of a water-soluble organic anionic and/or nonionic bar firmness aid, preferably sodium cocoyl isethionate or sodium lauroyl isethionate; and from about 15% to about 40% water.

The skin pH freezer bar is made by the following process steps:

I. mixing a molten (170°–205° F.; 76°–96° C.) mixture comprising said essentially free carboxylic acid; water; and bar firmness aid;

II. cooling said mixture to a semi-solid in a scraped wall heat exchanger freezer at a cooled temperature of 110°–195° F. (43°–91° C.);

III. extruding said semi-solid as a soft plug; and further cooling and crystallizing said soft plug until firm to provide said skin pH personal cleansing freezer bar.

The firm, low smear, ultra mild freezer bar has a shallow 25° C. penetration value of from zero up to 12 mm.

12 Claims, No Drawings

SKIN PH FREEZER BAR AND PROCESS

TECHNICAL FIELD

This invention relates to carboxylic acid based freezer cleansing bars and a process for making same.

BACKGROUND

U.S. Pat. No. 3,835,058, White, issued Sep. 10, 1974, incorporated herein by reference, discloses a freezer bar and process for making a soap bar.

The pH of healthy human skin is from about 4.8 to about 6. "Weakly acidic" means a pH of from about 4.8 to about 6 which is distinguished from a neutral or alkaline pH. A personal cleansing freezer bar having the three-dimensional structure is disclosed in commonly assigned, copending U.S. patent application Ser. No. 07/731,163, Taneri/Kacher et al., filed Jul. 15, 1991. The formation of a shaped, solid, three-dimensional skeleton (core) structure is described in commonly assigned, copending U.S. patent application Ser. No. 07/617,827, Kacher/Taneri/Camden/Vest/Bowles, filed Nov. 26, 1990. Kacher et al. does not specifically teach skin pH freezer bars. These commonly assigned patent applications do not teach skin pH freezer bars.

Firm, low smear, skin pH or weakly acidic cleansing bars believed to be novel. U.S. Pat. No. 3,557,006, Ferrara et al, issued Jan. 19, 1971, discloses a composite soap bar having an acid pH in use. Also see U.K. Pat. Specification 513,696, Mangeot, accepted Oct. 19, 1939. Jap. Pat. Application No. 54-151410, filed Nov. 21, 1979, and published Jun. 6, 1985, discloses a weakly acidic cleansing cream, but useful solids are not disclosed.

Commercial neutral pH bars, e.g., DOVE®, CARESS®, and OLAY®, usually contain only a maximum of about 5% moisture. Such prior art neutral pH bars are soft or have relatively poor smears. Prior art neutral pH bars containing substantial levels of hygroscopic materials, soft solids, or liquids, including water, are soft or sticky with poor smears.

Cleansing bars, per se, with reduced bar smear are reported in the art. E.g., U.S. Pat. No. 2,988,511, Mills, issued Jun. 13, 1961, incorporated herein by reference, discloses a low smearing bar.

Bar smear, also referred to as bar sloth, is the soft solid or mush that forms at the surface of a bar when submerged in water and is regarded by consumers as messy, unattractive, and uneconomical.

High moisture and low smear personal cleansing bars are disclosed in U.S. Pat. No. 4,606,839 Harding, issued Aug. 19, 1986. Harding uses coconut and/or palm kernel oil soap.

However, an examination of a used personal cleansing bars in today's average bathroom will show that there is still a need to improve cleansing bar smear.

Bar smear is especially poor in neutral pH bar formulations which contain higher levels (50%±10%) of synthetic surfactant.

The formation of rigid, soap curd fibers of sodium laurate is reported by L. Marton et al. in a 1940 Journal of American Chemical Society (Vol. 63, pp. 1990–1993). The report does not teach a utility for the soap curd. Shaped solids, as defined herein, are not disclosed by Marton et al. Additionally, the formation of this curd of fibers does not disclose free mono- or dicarboxylic acids.

Japanese Pat. J5 7030-798, Jul. 30, 1980, discloses transparent solid framed or molded soap bar in which fatty acids constituting the soap component are myristic, palmitic, and stearic acids. A transparent soap is described in which at least 90 wt. % of the fatty acids which constitute the soap component are myristic acid, palmitic acid, and stearic acid. The product is reported as a transparent, solid soap having good frothing and solidifying properties, good storage stability, and a low irritant effect on human skin. The process and transparent bar soap composition exemplified in Jap. J5 7030-798 do not appear to contain synthetic surfactant.

It is an object of the present invention to produce a firm, mild, skin pH, low smear cleansing freezer bar that contains relatively high level of moisture in the presence of a synthetic surfactant and soft solids, such as water-soluble polyols and hydrocarbon greases.

SUMMARY OF THE INVENTION

The invention provides a firm, low smear, ultra mild, weakly acidic skin pH personal cleansing freezer bar comprising by weight of said bar: a sum total of from about 10% to about 50% of essentially free carboxylic acid, preferably myristic acid, behenic acid, or 12-hydroxy stearic acid; from about 15% to about 65% of a water-soluble organic anionic and/or nonionic bar firmness aid, preferably sodium cocoyl isethionate or sodium lauroyl isethionate; and from about 15% to about 40% water. The firm, low smear, ultra mild freezer bar has a shallow penetration value of from zero up to 12 mm.

The freezer bar is made by the followings steps:

I. mixing a molten (170°–205° F.; 76°–96° C.) mixture comprising said essentially free carboxylic acid; water; and bar firmness aid; optionally partially drying;

II. cooling said mixture to a semi-solid in a scraped wall heat exchanger freezer at a cooled temperature of 100°–195° F. (43°–91° C.);

III. extruding said semi-solid as a soft plug; and further cooling and crystallizing said soft plug until firm to provide said skin pH personal cleansing freezer bar.

DETAILED DESCRIPTION OF THE INVENTION

The present invention provides a firm, ultra mild, weakly acidic skin pH freezer bar comprising by weight of said bar: a sum total of from about 10% to about 50% of essentially free carboxylic acid; from about 15% to about 65% of a water-soluble organic anionic and/or nonionic bar firmness aid; and from about 15% to about 40% water. The firm, low smear, ultra mild freezer bar has a shallow penetration value of from zero up to 12 mm.

The Skin pH Freezer Bar Process

In another respect, the present invention relates to a process for making a skin pH freezer bar.

The freezer bar skin pH freezer process comprises the following steps:

I. mixing a molten (170°–205° F.; 76°–96° C.) mixture comprising said essentially free carboxylic acid; water; and bar firmness aid; optionally partially drying;

II. cooling said mixture to a semi-solid in a scraped wall heat exchanger freezer at a cooled temperature of 110°–195° F. (43°–91° C.);

III. extruding said semi-solid as a soft plug; and further cooling and crystallizing said soft plug until firm to provide said skin pH personal cleansing freezer bar.

The term "water-soluble" with respect to the "bar firmness aid" means a solubility of at least 4 parts in 10 parts water at Step I temperatures.

"Essentially free carboxylic acid" as defined herein means that the "free" carboxylic acid is from about 85% to about 100% by weight of free and neutralized carboxylic acid present in the bar. Conversely, any neutralized carboxylic acid present in the bar is from 0% to about 15% by weight of free and neutralized carboxylic acid present in the bar.

A neutralized carboxylic acid can have a cation selected from the group consisting of sodium, magnesium, calcium, aluminum, and mixtures thereof, but this is defined as an essentially free carboxylic acid bar.

The terms "neutralized carboxylic acid," "soap", "fatty acid (FA) salts" and "monocarboxylic acid salts" as used herein are used interchangeably.

In the preferred freezer bar process, the molten mixture of Step I preferably comprises a liquid crystalline middle phase; said molten mixture has:

a viscosity of from about 100,000 cps to about 1,000,000 cps at a shear rate of about 1 $sec^{-1}$;

wherein said viscosity is from about 5,000 cps to about 100,000 cps at a shear rate of about 5 $sec^{-1}$;

a viscosity of from about 1,000 cps to about 50,000 cps at a shear rate of about 20 $sec^{-1}$;

a viscosity of from about 500 cps to about 12,000 cps at a shear rate of about 50 $sec^{-1}$.

The ratio of synthetic surfactant to water to form said middle phase is from about 2:1 to about 1:2; more preferably from about 1.5:1 to about 0.75:1.

The liquid crystalline middle phase can be identified with polarized light microscopy.

The skin pH freezer bar process molten mixture viscosity is preferably from about 100,000 cps to about 500,000 cps at a shear rate of about 1 $sec^{-1}$; and is from about 5,000 cps to about 65,000 cps at a shear rate of about 5 $sec^{-1}$; and is from about 2,500 cps to about 25,000 cps at a shear rate of about 20 $sec^{-1}$; and is from about 1,000 cps to about 5,000 cps at a shear rate of from about 50 $sec^{-1}$. The synthetic surfactant to form said middle phase is preferably a sodium salt containing $C_{10}$–$C_{18}$ alkylene chains and is selected from the group consisting of alkyl glyceryl ether sulfonates, acyl isethionates, glucose amides, and mixtures thereof; more preferably sodium acyl isethionate; and most preferably sodium cocoyl isethionate and sodium lauryl isethionate, and mixtures thereof.

The skin pH freezer bar process is preferred when the bar contains a starch at a level of from about 0.5% to about 30% by weight of said bar and the starch is selected from the group consisting of corn starch and dextrin.

The skin pH freezer bar process is preferred when the freezer outlet temperature is from about 150°–180° F. (60°–82° C.). A highly preferred process is where the viscosity obtained in Step I is sufficient that no cooling is necessary in Step II in order to extrude said mixture as a soft plug.

The process aqueous molten mixture of Step I preferably comprises: from about 20% to about 30% of said water, from about 15% to about 25% of said carboxylic acid, and from about 20% to about 30% of synthetic surfactant.

The above process is preferred when the aqueous molten liquid is made without any neutralization step. However, in the aqueous mixture of said carboxylic acid containing other ingredients, some sodium soap may be formed.

The above process is preferred when from about 2% to about 15% by weight of said bar is a "crystallization enhancing salt" selected from the group consisting of: sodium salt of sulfate, chloride, acetate, isethionate and citrate, and mixtures thereof.

The above process is preferred when said aqueous molten liquid aqueous phase contains from about 2% to about 40% of a bar firmness aid selected from the group disclosed herein.

The bar firmness aid appears to increase the level of the essentially free carboxylic acid dissolved in said continuous molten aqueous phase in Step I.

The above process is preferred when said aqueous phase contains from about 20% to about 95%, preferably from about 35% to about 75%, water by weight of said aqueous phase.

The preferred bar has a penetration value at 25° C. of from about 3 mm to about 9 mm for a 25 mm bar sample.

The firm cleansing bar has a penetration value of from zero up to 12 mm as measured at 25° C., preferably at 50° C., using a 247 gram Standard Weighted Penetrometer Probe having a conical needle attached to a 9 inch (22.9 cm) shaft, weighing 47 grams with 200 grams on top of said shaft for a total of said 247 grams, said conical needle having a 19/32 inch (1.51 cm) top and a 1/32 inch (0.08 cm) point.

Since healthy human skin is slightly acidic (pH from about 4.8 to about 6.0), it is desirable that a skin cleansing bar also have a similar, slightly acidic pH. Additionally, such formulations can contain high levels of carboxylic acid while containing very little, if any, harsh soap.

In another respect, the present invention provides a firm, ultra mild, weakly acidic skin pH cleansing bar comprising: at least two phases and a sum total of from about 10% to about 50% of free carboxylic acid or a mixture of free and neutralized carboxylic acid; from about 15% to about 65% of an anionic and/or nonionic bar firmness aid of which at least about 10% by weight of said bar is a synthetic surfactant; and from about 15% to about 40% water by weight of said bar.

One particularly surprising aspect of the present invention is that the anionic and/or nonionic bar firmness aid are required to form an acceptably firm bar. These bar firmness aids include solvents such as propylene glycol and synthetic surfactants, such as sodium acyl isethionate, that typically result in bar softening in conventional bars, especially in the presence of relatively high levels of water.

In another respect, the bar of the present invention comprises a rigid crystalline phase skeleton structure comprising an interlocking, open three-dimensional mesh of elongated crystals consisting essentially of said free carboxylic acid.

Another phase in the bar of the present invention is an aqueous phase mix. The aqueous mix (when measured alone without carboxylic acid) has a penetration value of greater than 12 mm to complete penetration at 25° C.

More specifically, the skeleton structure is a relatively rigid, interlocking, open, three-dimensional mesh of free or essential free monocarboxylic acid elongated crystals.

The "elongated crystals" are platelets and/or fibers.

The terms "skeleton structure," "skeletal structure," "core," and "skeleton frame" are often used interchangeably herein.

The term "shaped solid" as used herein includes forms such as bars, cakes, and the like. The term "bar" as used herein includes the same unless otherwise specified.

The term "mesh" as used herein means in interlocking crystalline skeleton network with voids or openings when viewed under magnification of from about 1000× to about 5000× by scanning electron microscopy.

The three-dimensional mesh can be seen using a Scanning Electron Microscope. The Scanning Electron Microscopy (SEM) sample preparation involves fracturing a bar (shaped solid) with simple pressure to obtain a fresh surface for examination. The fractured sample is reduced in size (razor blade) to approximately a 10 mm×15 mm rectangle with a thickness of about 5 mm. The sample is mounted on an aluminum SEM stub using silver paint adhesive. The mounted sample is coated with approximately 300 angstroms of gold/palladium in a Pelco sputter coater. Prior to coating, the sample is subjected to vacuum for a period of time which is sufficient to allow sufficient loss of bar moisture assuring acceptable coating quality. After coating, the sample is transferred to the SEM chamber and examined under standard SEM operating conditions with an Hitachi Model S570 Scanning Electron Microscope in order to see the skeletal (core) frame.

The elongated crystals are composed of essentially free carboxylic acid and are therefore are different from the soap, primarily neutralized carboxylic acid, elongated crystals of commonly assigned U.S. patent application Ser. No. 07/617,827, Kacher et al., filed Nov. 26, 1990, now abandoned in favor of commonly assigned U.S. patent application Ser. No. 07/782,956, filed Nov. 1, 1991, incorporated herein be reference.

In another respect, the present invention provides an improved firm, skin pH cleansing bar which is comprised of said skeleton structure. Some shaped solids are in the form of cleansing bars which contain surprisingly high levels of said aqueous phase comprising water, other liquids and soft materials. Notwithstanding the presence of relatively large levels of an aqueous phase, the preferred bars of the present invention maintain their rigidity and excellent smear properties, even when allowed to soak overnight in water. While not being bound to any theory, the shaped solid comprising these phases is similar to a relatively rigid wet sponge.

The crystalline phase comprises elongated crystals in the form of either interlocking platelets and/or fibers, usually platelets. Preferably said crystals are composed of free fatty acids. The interlocking mesh of said fibers and/or platelets imparts strength to the three-dimensional structure, even in the presence of relatively high levels of water or other soft materials; even when allowed to soak overnight in water.

The bar firmness, i.e., strength of the skeleton structure, can be measured by the resistance to penetration of the bar using a Standard Weighted Penetrometer Probe. See Bar Hardness Test below for more details. The bar is of sufficient firmness or rigidity that a 20 mm thick or greater cleansing bar sample has a penetration at 25° C. of from about zero mm to about 12 mm, preferably from about 1 mm to about 20 mm, more preferably from about 3 mm to about 8 mm.

The present bars are distinguished from conventional transparent bars based on crystal size, as well as other characteristics. The crystals or crystal bundles that make-up the interlocking mesh structure of the present invention preferably are of a size that diffracts light and consequently are greater than 400 nm in either diameter or length. On the other hand, conventional transparent bars gain their transparency by having crystal diameters or length less than the wavelength of white light, which is greater than about 400 nm and, consequently, do not diffract light.

While not being bound to any theory, the skeletal structure is theorized to contain substantial "void" areas which are filled by soft and/or liquid aqueous phases. It is a surprising aspect of this invention that the physical properties of the bar, such as bar hardness and little smear, are mostly dependent on the crystalline interlocking mesh structure, even when the other phases make up a majority of the materials present. In conventional bars, many components can impact the overall bar physical properties because the components either modify the phase and structure of the soap or synthetic surfactant components that primarily determine the bar's physical properties. The combination of two or more phases (e.g., soap and aqueous solution) drastically changes the colloidal structure, and consequently, the physical properties of a conventional bar.

Thus, conventional bars are more limited in the type, levels and composition of soft phase materials that can be incorporated into the bar than the present invention. Such phases include most materials that are either flowable liquids or materials that are softer than the minimum hardness of an acceptable bar. These phases include aqueous solutions, liquid crystalline phases composed of water and surfactant, polymers; particularly surfactant-containing crystalline phases, and especially hygroscopic surfactants, which tend to become soft and sticky when mixed with water or other liquid phases including water-soluble organics (e.g., propylene glycol and glycerine), hydrophobic materials (e.g., mineral oil, liquid triglycerides), or soft hydrophobic materials, e.g., petrolatum, low melting paraffin, and low melting triglycerides.

In physical terms, all these phases can be characterized as being flowable liquids or so soft that a Standard Weighted Penetrometer Probe, as defined herein, will penetrate all the way through a 12 mm thick sample, in other words, greater than 12 mm. These phases can be selectively included in the structure of the present invention without loss of the interlocking mesh structure and certain desirable physical properties.

The invention is a firm, low smear, ultra mild, skin pH bar comprising free, or essentially free, mono- and/or di-carboxylic acid elongated crystals.

The Free Carboxylic Acid

In the preferred embodiment, said elongated crystals are composed of essentially free carboxylic acid, particularly, free fatty acid of which at least about 25% have saturated fatty alkyl chains of a single chain length. The free fatty acid is at least 85% by weight of the sum total of free and neutralized carboxylic acid in the skin pH cleansing bar formulation.

A preferred skin pH bar contains mono-carboxylic acid, wherein at least 80% of said mono-carboxylic acid has the following general formula:

$$H-(CH_2)_a-\underset{\underset{X}{|}}{CH}-(CH_2)_b-CO_2-H$$

wherein:

a+b=10 to 20 each a, b=0 to 20

X=H, OR, $$O-\overset{\overset{O}{\|}}{C}-R_1.$$

R, or mixture thereof;

R=$C_1$-$C_3$ alkyl, H, or mixtures thereof;

$R_1$=$C_1$-$C_3$ alkyl.

The carboxylic acids are preferred when: X=H, and a+b=12-20, or X=OH, a=10-16, b=0, or 12-hydroxy stearic acid for said monocarboxylic acid. 12-hydroxy stearic acid forms fibrous elongated crystals.

The ultra mild, weakly acidic skin pH cleansing bar is preferred when said neutralized carboxylic acid is a sodium salt and the free carboxylic acid and neutralized carboxylic acid sum is from about 10% to about 40%, more preferably from about 15% to about 30%, by weight of the bar.

The ultra mild, weakly acidic skin pH cleansing bar is preferred when said carboxylic acid is a monocarboxylic acid and wherein free carboxylic acid is from about 95% to about 100% and said neutralized monocarboxylic acid is from 0% to about 5% of said mixture of free monocarboxylic acid and neutralized monocarboxylic acid; and wherein said free monocarboxylic acid and neutralized monocarboxylic acid sum total is from about 15% to about 25% by weight of said bar; and wherein X=H and a+b=10-20 or said monocarboxylic acid is 12-hydroxy stearic acid.

A highly preferred monocarboxylic acid is selected from the group consisting of myristic acid, behenic acid, and 12-hydroxy stearic acid, and mixtures thereof.

Bar Firmness Aid

The ultra mild, weakly acidic skin pH cleansing bar's firmness aid is a water-soluble organic preferably selected from the group consisting of:

I. from about 10% to about 50% by weight of a synthetic surfactant wherein said synthetic surfactant is selected from the group consisting of: alkyl sulfates, paraffin sulfonates, alkyl glyceryl ether sulfonates, anionic acyl sarcosinates, methyl acyl taurates, linear alkyl benzene sulfonates, N-acyl glutamates, alkyl glucosides, alpha sulfo fatty acid esters, acyl isethionates, glucose amide alkyl sulfosuccinates, alkyl ether carboxylates, alkyl phosphate esters, ethoxylated alkyl phosphate esters, methyl glucose esters, protein condensates, the alkyl ether sulfates with 1 to 12 ethoxy groups, and mixtures thereof, wherein said surfactants contain $C_8$-$C_{22}$ alkylene chains; and mixtures thereof; and II. from 0% to about 40% by weight of a co-solvent wherein said co-solvent is selected from the group consisting of:

(a) non-volatile, water-soluble nonionic organic solvents selected from the group consisting of: a polyol of the structure:

$$R_3-O(CH_2-\underset{\underset{R_4}{|}}{CHO})_kH$$

where $R_3$=H or $C_1$-$C_4$ alkyl; $R_4$=H or $CH_3$; and k=1-200; $C_2$-$C_{10}$ alkane diols; sorbitol; glycerine; sugars; sugar derivatives; urea; and ethanol amines of the general structure $(HOCH_2CH_2)_xNH_y$ where x=1-3; y=0-2; and x+y=3;

(b) alcohols of from 1 to 5 carbon atoms; and mixtures thereof; and

III. mixtures of (a) and (b).

It is surprising that the above bar firmness aids to act to firm up the bar of the present invention.

The synthetic surfactant is preferably from about 10% to about 40% by weight of said bar. The synthetic surfactant preferably contains $C_{10}$-$C_{18}$ alkylene chains and is a sodium salt.

The skin pH cleansing bar is more preferred when it contains synthetic surfactant at a level of from about 20% to about 30% by weight of said bar; And wherein said synthetic surfactant is a sodium salt selected from the group consisting of: alkyl sulfates, alkyl glyceryl ether sulfonates, linear alkyl benzene sulfonates, alpha sulfo fatty acid esters, acyl isethionates, glucose amides, ethoxylated alkyl ether sulfates with 1 to 6 ethoxy groups, and mixtures thereof, wherein said surfactants contain $C_{10}$-$C_{18}$ alkylene chains; and mixtures thereof.

The co-solvent level is preferably is from 0% to about 15% by weight of said bar.

The preferred water level is from about 20% to about 30% by weight of said bar.

A preferred synthetic surfactant is a sodium acyl isethionate selected from the group consisting of sodium cocoyl isethionate and sodium lauroyl isethionate, and mixtures thereof.

A preferred co-solvent level is from about 2% to about 15% by weight of said bar, and wherein said co-solvent is selected from the group consisting of: said polyol wherein $R_3$=H, and K=1-5; glycerin; sugars; sugar derivatives; urea; said ethanol amines, and mixtures thereof. A more preferred co-solvent level is from about 2% to about 10% by weight of said bar, when the co-solvent is selected from the group consisting of: propylene glycol, sucrose, lactose, glycerine, and mixtures thereof. Preferred bar firmness aids have a solubility of at least 4 parts in 10 parts of water at 170°-180° F. (77°-82° C.).

The preferred water level is from about 20% to about 30% by weight of said bar.

The skin pH bars of this invention are made by a frame process. A skin pH freezer bar and process which requires special conditions are disclosed in commonly assigned, copending U.S. patent application Ser. No. 854,933, Kacher et al., filed of even date, Mar. 20, 1992, incorporated herein by reference in its entirety.

Other Cleansing Bar Ingredients

The skin pH cleansing bar can contain from about 0.1% to about 60% of other cleansing bar ingredients selected from the group consisting of:

from about 0.5% to about 1% said potassium soap;

from about 0.5% to about 1% triethanolammonium soap;

from about 1% to about 40% of impalpable water-insoluble materials selected from the group consisting of calcium carbonate and talc;

from about 0.1% to about 20% of a polymeric skin feel aid;

from about 0.5% to about 25% of aluminosilicate clay and/or other clays;

wherein said aluminosilicates and clays are selected from the group consisting of zeolites; kaolin, kaolinite, montmorillonite, attapulgite, illite, bentonite, halloysite, and calcined clays;

from about 1% to about 40% of salt and salt hydrates; and mixtures thereof;

wherein said salt and salt hydrate have a cation selected from the group consisting of: sodium, potassium, magnesium, calcium, aluminum, lithium, ammonium, monoethanol ammonium, diethanolammonium, and triethanolammonium; and wherein said salt and salt hydrate have an anion selected from the group consisting of: chloride, bromide, sulfate, metasilicate, orthophosphate, pyrophosphate, polyphosphate, metaborate, tetraborate, carbonate, bicarbonate, hydrogen phosphate, isethionate, methyl sulfate, and mono- and polycarboxylate of 6 carbon atoms or less;

from about 0.5% to about 30% of a starch;

from about 1% to about 20% of an amphoteric co-surfactant selected from the group consisting of alkyl bentaines, alkyl sultaines, and trialkyl amine oxides; and mixtures thereof;

from about 0.1% to about 40% of a hydrophobic material selected from the group consisting of: microcrystalline wax, petrolatum, carnauba wax, palm wax, candelilla wax, sugarcane wax, vegetable derived triglycerides, beeswax, spermaceti, lanolin, wood wax, shellac wax, animal derived triglycerides, montar, paraffin, oxokerite, ceresin, and Fischer-Tropsch wax.

The preferred level of said amphoteric co-surfactant is from about 2% to about 10% and the amphoteric co-surfactant is selected from the group consisting of: cocobetaine, cocoamidopropylbetaine, cocodimethylamine oxide, and cocoamidopropyl hydroxysultaine.

The bar can preferably contain from about 2% to about 35% of said hydrophobic material; said hydrophobic material comprising paraffin wax, having a melting point of from about 49° C. (120° F.) to about 85° C. (185° F.), and petrolatum, and mixtures thereof; the bar can more preferably contain from about 3% to about 15% by weight of the bar of paraffin wax.

The bar can preferably contain from about 1% to about 20% of said salts and said salt is selected from the group consisting of: sodium chloride, sodium sulfate, disodium hydrogen phosphate, sodium pyrophosphate, sodium tetraborate, sodium acetate, sodium citrate, and sodium isethionate, and mixtures thereof.

The bar can more preferably contain salt at a level of from about 4% to about 15% and said salt is preferably selected from the group consisting of sodium chloride and sodium isethionate.

The bar can preferably contain: from about 1% to about 15% by weight of said impalpable water-insoluble materials; from about 0.1% to about 3%, of said polymeric skin feel aid, said polymeric skin feel aid selected from the group consisting of guar, quaternized guar, and quaternized polysaccharides; from about 1% to about 15% said aluminosilicate and/or other clays; and from about 1% to about 15% said starch; wherein said starch is selected from the group consisting of corn starch and dextrin.

The aqueous phase mix alone contains from about 20% to about 95% water by weight of said aqueous phase. The aqueous phase can contain from about 35% to about 75% water by weight of said aqueous phase.

The skin pH bar can have miscellaneous non-carboxylic acid phases comprising droplets or crystals selected from waxes, petrolatum, and clays.

The above skin pH cleansing bar is preferred when said bar contains said free carboxylic acid and water; and some synthetic surfactant selected from the group consisting of: alkyl sulfates, paraffin sulfonates, alkylglycerylether sulfonates, acyl sarcosinates, methylacyl taurates, linear alkyl benzene sulfonates, N-acyl glutamates, alkyl glucosides, alpha sulfo fatty acid esters, acyl isethionates, alkyl sulfosuccinates, alkyl ether carboxylates, alkyl phosphate esters, ethoxylated alkyl phosphate esters, methyl glucose esters, protein condensates, alkyl amine oxides, alkyl bentaines, alkyl sultaines, the alkyl ether sulfates with 1 to 12 ethoxy groups, and mixtures thereof, wherein said surfactants contain $C_8$–$C_{22}$ alkyl chains.

The above skin pH cleansing bar is preferred when said synthetic surfactant is hygroscopic; said hygroscopic surfactant being defined as a surfactant which absorbs at least 20% of its dry weight in water at 26° C. and 80% Relative Humidity in three days and wherein said bar is relatively non-swelling.

The above cleansing bar is preferred when said hygroscopic surfactant is selected from the group consisting of alpha sulfo fatty acid esters; alkyl sulfates; alkyl ether carboxylates; alkyl betaines; alkyl sultaines; alkyl amine oxides; alkyl ether sulfates; and mixtures thereof.

The freezer bar process is preferred when said bar composition has miscellaneous non-carboxylic acid phases comprising droplets or crystals selected from synthetic surfactant, waxes, petrolatum, clays, and the like.

A highly preferred cleansing bar comprises: various combinations of the core structure of free carboxylic acid platelets and/or fibers, water, bar firmness aids, mild synthetic surfactants, bar appearance stabilizers, skin mildness aides and other cleansing bar adjuvants. Such preferred bar can be formulated to have essentially no bar smear.

Some compositions of this invention comprise the above-defined rigid mesh with water and without water. These components must be formed with water or another suitable solvent system. The compositions can be made with large amounts of water and the water level in the final composition can be reduced to as low as about 1% or 2%.

However, it is a special advantage of some structures described herein that they can be dehydrated without loss of the integrity of the mesh. Some preferred shaped solids can be dehydrated without appreciable change in their outer dimensions. Other bars shrink while maintaining their three-dimensional form. Some bars herein have the unique characteristic that they are not destroyed by dehydration.

The percentages, ratios, and parts herein are on a total composition weight basis, unless otherwise specified. All levels and ranges herein are approximations unless otherwise specified.

Some preferred compositions contain little or no short chain FA's of ten carbon atoms or less as shown in Table A by weight of the carboxylic acid.

TABLE A

| The Total Percent Unsaturated or Low ($C_{10}$ or less) Chain Length Carboxylic Acids | | |
|---|---|---|
| Broad | Preferred | More Preferred |
| 0-15% | 0-5% | 0-1% |

The highs and lows of some key preferred optional ingredients for complex cleansing bar compositions of this invention are set out herein. None of these ingredients is essential for the basic, preferred bar core structure. Zero is the lowest level for each optional ingredient. Some preferred bars can contain a total of from about 0.1% up to about 70% of such ingredients. The idea here is that the core bars can contain large amounts of other ingredients besides fatty acids, bar firmness aids, soap, and water.

Examples of suitable synthetic detergents for use herein, as bar firmness aids or as lather booster "co-surfactants," are those described in U.S. Pat. No. 3,351,558, Zimmerer, issued Nov. 7, 1967, at column 6, line 70 to column 7, line 74, said patent incorporated herein by reference.

Examples include the water-soluble salts of organic, sulfonic acids and of aliphatic sulfuric acid esters, that is, water-soluble salts of organic sulfuric reaction products having in the molecular structure an alkyl radical of from 10 to 22 carbon atoms and a radical selected from the group consisting of sulfonic acid and sulfuric acid ester radicals.

Synthetic sulfate detergents of special interest are the normally solid alkali metal salts of sulfuric acid esters of normal primary aliphatic alcohols having from 10 to 22 carbon atoms. Thus, the sodium and potassium salts of alkyl sulfuric acids obtained from the mixed higher alcohols derived by the reduction of tallow or by the reduction of coconut oil, palm oil, stearine, palm kernel oil, babassu kernel oil or other oils of the coconut group can be used herein.

Other aliphatic sulfuric acid esters which can be suitably employed include the water-soluble salts of sulfuric acid esters of polyhydric alcohols incompletely esterified with high molecular weight soap-forming carboxylic acids. Such synthetic detergents include the water-soluble alkali metal salts of sulfuric acid esters of higher molecular weight fatty acid monoglycerides such as the sodium and potassium salts of the coconut oil fatty acid monoester of 1,2-hydroxypropane-3-sulfuric acid ester, sodium and potassium monomyristoyl esthylene glycol sulfate, and sodium and potassium monolauroyl diglycerol sulfate.

It is noted that surfactant mildness can be measured by a skin barrier destruction test which is used to assess the irritancy potential of surfactants. In this test the milder the surfactant, the lesser the skin barrier is destroyed. Skin barrier destruction is measured by the relative amount of radio-labeled water ($^3H$-$H_2O$) which passes from the test solution through the skin epidermis into the physiological buffer contained in the diffusate chamber. This test is described by T.J. Franz in the *J. Invest. Dermatol.*, 1975, 64, pp. 190-195; and in U.S. Pat. No. 4,673,525, Small et al., issued Jun. 16, 1987, incorporated herein by reference, and which disclose a mild alkyl glyceryl ether sulfonate (AGS) surfactant based synbar comprising a "standard" alkyl glyceryl ether sulfonate mixture. Barrier destruction testing is used to select mild surfactants. Some preferred mild synthetic surfactants are disclosed in the above Small et al. patents and Rys et al. Some specific examples of preferred surfactants are used in the Examples herein.

Some examples of good lather enhancing detergent surfactants, mild ones, are e.g., sodium lauroyl sarcosinate, sodium cocoyl isethionate, alkyl glyceryl ether sulfonate, sulfonated fatty esters, paraffin sulfonates, and sulfonated fatty acids.

The hygroscopic surfactants are defined herein as having a minimum of 20% total moisture gain after 3 days at 26° C. and 80% Relative Humidity.

A mild skin pH cleansing bar of the present invention can contain from about 0.5% to about 20% of a mixture of a silicone gum and a silicone fluid wherein the gum:fluid ratio is from about 10:1 to about 1:10, preferably from about 4:1 to about 1:4, most preferably from about 3:2 to about 3:3.

Other ingredients of the present invention are selected for the various applications. E.g., perfumes can be used in formulating the skin cleansing products, generally at a level of from about 0.1% to about 2.0% of the composition. Alcohols, hydrotropes, colorants, and fillers such as talc, clay, water-insoluble, impalpable calcium carbonate and dextrin can also be used. Ceteryl alcohol is a mixture of cetyl and stearyl alcohols. Preservatives, e.g., sodium ethylenediaminetetraacetate (EDTA), generally at a level of less than 1% of the composition, can be incorporated in the cleansing products to prevent color and odor degradation. Antibaceterials can also be incorporated, usually at levels up to 1.5%. The above patents disclose or refer to such ingredients and formulations which can be used in the bars of this invention, and are incorporated herein by reference.

Bar Appearance Aids

Bar appearance (water-retaining and/or shrinkage prevention) aids are preferably selected from the group consisting of:

compatible salt and salt hydrates;
water-soluble organics such as polyols, urea;
aluminosilicates and clays; and
mixtures thereof.

Some of these water-soluble organics serve as co-solvents which are used as bar firmness aids. They also serve to stabilize the appearance of the bar of the present invention. Some preferred water-soluble organics are propylene glycol, glycerine, ethylene glycol, sucrose, and urea, and other compatible polyols.

A particularly suitable water-soluble organic is propylene glycol. Other compatible organics include polyols, such as ethylene glycol or 1,7-heptane-diol, respectively the mono- and polyethylene and propylene glycols of up to about 8,000 molecular weight, any mono-$C_{1-4}$ alkyl ethers thereof, sorbitol, glycerol, glycose, diglycerol, sucrose, lactose, dextrose, 2-pentanol, 1-butanol, mono- di- and triethanolammonium, 2-amino-1-butanol, and the like, especially the polyhydric alcohols.

The term "polyol" as used herein includes non-reducing sugar, e.g., sucrose. Sucrose will not reduce Fehling's solution and therefore is classified as a "non-reducing" disaccharide. Unless otherwise specified, the term "sucrose" as used herein includes sucrose, its derivatives, and similar non-reducing sugars and similar polyols which are substantially stable at a soap processing temperature of up to about 210° F. (98° C.), e.g., trehalose, raffinose, and stachyose; and sorbitol, lactitol and maltitol.

Compatible salt and salt hydrates are used to stabilize the bar soap appearance via the retention of water. Some preferred salts are sodium chloride, sodium sulfate, disodium hydrogen phosphate, sodium pyrophosphate, sodium tetraborate.

Generally, compatible salts and salt hydrates include the sodium, potassium, magnesium, calcium, aluminum, lithium, and ammonium salts of inorganic acids and small (6 carbons or less) carboxylic or other organic acids, corresponding hydrates, and mixtures thereof, are applicable. The inorganic salts include chloride, bromide, sulfate, metasilicate, orthophosphate, pyrophosphate, polyphosphate, metaborate, tetraborate, and carbonate. The organic salts include acetate, formate, methyl sulfate, and citrate.

Water-soluble amine salts can also be used. Monoethanolamine, diethanolamine, and triethanolammonium (TEA) chloride salts are preferred.

Aluminosilicates and other clays are useful in the present invention. Some preferred clays are disclosed in U.S. Pat. Nos. 4,605,509 and 4,274,975, incorporated herein by reference.

Other types of clays include zeolite, kaolinite, montmorillonite, attapulgite, illite, bentonite, and halloysite. Another preferred clay is kaolin.

Waxes include petroleum based waxes (paraffin, microcrystalline, and petrolatum), vegetable based waxes (carnauba, palm wax, candelilla, sugarcane wax, and vegetable derived triglycerides) animal waxes (beeswax, spermaceti, wool wax, shellac wax, and animal derived triglycerides), mineral waxes (montar, oxokerite, and ceresin) and synthetic waxes (Fischer-Tropsch).

A preferred wax is used in the Examples herein. A useful wax has a melting point (M.P.) of from about 120° F. to about 185° F. (49°-85° C.), preferably from about 125° F. to about 175° F. (52°-79° C.). A preferred paraffin wax is a fully refined petroleum wax having a melting point ranging from about 130° F. to about 140° F. (49°-60° C.). This wax is odorless and tasteless and meets FDA requirements for use as coatings for food and food packages. Such paraffins are readily available commercially. A very suitable paraffin can be obtained, for example, from The Standard Oil Company of Ohio under the trade name Factowax R-133.

Other suitable waxes are sold by the National Wax Co. under the trade names of 9182 and 6971, respectively, having melting points of 131° F. and 130° F. (~55° C.). Another suitable was is sold by Exxon Corp. under the trade name 158, having a melting point of 158° F. (70° C.).

The paraffin preferably is present in the bar in an amount ranging from about 5% to about 20% by weight. The paraffin ingredient is used in the product to impart skin mildness, plasticity, firmness, and processability. It also provides a glossy look and smooth feel to the bar.

The paraffin ingredient is optionally supplemented by a microcrystalline wax. A suitable microcrystalline wax has a melting point ranging, for example, from about 140° F. (60° C.) to about 185° F. (85° C.), preferably from about 145° F. (62° C.) to about 175° F. (79° C.). the wax preferably should meet the FDA requirements for food grade microcrystalline waxes. A very suitable microcrystalline wax is obtained from Witco Chemical Company under the trade name Multiwax X-145A. The microcrystalline wax preferably is present in the bar is an amount ranging from about 0.5% to about 5% by weight. The microcrystalline wax ingredient imparts pliability to the bar at room temperatures.

EXAMPLES

The following examples are illustrative and are not intended to limit the scope of the invention. All levels and ranges, temperatures, results, etc., used herein, are approximations unless otherwise specified.

DESCRIPTION OF TESTING FOR EXAMPLES

Bar Hardness Test

1. The hardness of a bar is determined by measuring at 25° C. the depth of penetration (in mm) into the bar, as described herein. A separate elevated temperature bar hardness can also be measured at 49° C.

Bar Smear Test

2. The smear grade is determined by a (1) placing a soap bar on a perch in a 1400 mm diameter circular dish; (2) adding 200 ml of room temperature water to the disk such that the bottom 3 mm of the bar is submerged in water; (3) letting the bar soak overnight (15 hours); (4) turning the bar over and grading qualitatively for the combined amount of smear, and characteristics of smear, depth of smear on a scale where 10 equals no smear, 8.0-9.5 equals low smear amount, 5.0-7.5 equals moderate smears similar to most marketed bars, and 4.5 or less equals very poor smear.

Commercial soap bars, e.g., SAFEGUARD®, ZEST®, IVORY®, and LAVA®, have smears of about 5, 6, 6, and 6, respectively.

Example Y is a preferred skin pH frame bar that has excellent firmness, even at elevated storage conditions (49° C.), very little smear, and good lather.

SKIN pH FREEZER BAR EXAMPLES

The Examples below are made by a freezer bar process. This process provides a firm, mild, low smear skin pH personal cleansing freezer bar comprising a skeleton structure having a relatively rigid, interlocking, semi-continuous, open, three-dimensional, crystalline mesh of free carboxylic acid made by the following steps:

I. mixing a molten (170°-205° F.; 76°-96° C.) mixture comprising by weight of said bar: from about 10% to about 50% of essentially free monocarboxylic acid, from about 15% to about 40% water; and from about 15% to about 65% of an anionic and/or nonionic bar firmness aid of which at least about 10% by weight of said bar is a synthetic surfactant; optionally drying;

II. cooling said mixture to a semi-solid in a scraped wall heat exchanger freezer at a cooled temperature of 110°-195° F. (43°-91° C.);

III. extruding said semi-solid as a soft plug; and further cooling and crystallizing said soft plug until firm to provide said skin pH personal cleansing freezer bar.

The following Examples are made using the following general procedure.

Step I—Mixing

The preferred order of addition to form the mixture is as follows:

1. free carboxylic acid;
2. co-solvents;
3. solid surfactants such as sodium cocoyl isethionate;

4. liquid or soft surfactants, including aqueous solutions, pastes, etc., such as sodium linear alkyl benzene sulfonate;
5. glydant, if used;
6. sodium isethionate, if used;
7. solution of sodium chloride in water;
8. half of total starch, if used;
9. balance of water;
10. balance of starch, if used; and
11. perfume;

The molten mixture is mixed at from about 170° F. to about 205° F. (76°-96° C.) to form the molten aqueous mixture. The optimal mixing temperatures can vary depending on the particular formulation. Temperatures above 210° F. (99° C.) can result in oxidation and may also cause boil over and aeration of the molten mixture.

Optional Steps—Aeration, Minor Addition, and Flash Drying Optionals

Aerate (optional) said mix and add perfume (only if drying) and other minors with positive displacement pump or other in-line mixer. These Examples are not aerated or dried. The mixture of Step I is optionally dried to reduce the amount of said water to the desired level, preferably 20-30% water. The flash drying temperature is from about 225° F. to about 315° F. (135°-157° C.) at pressure of from about 30 to about 100 psi (115-517 mm Hg). In most preferred cases of the present invention, there is no drying step.

Step II—Freezer

Cool the mix using a scraped wall heat exchanger (freezer) to partially crystallize the components from an initial temperature of from about 180° F. to about 200° F. (82°-93° C.) or from about 200° F. to about 220° F. (93°-104° C.), if dried, to a final temperature of preferably from about 110° F. to about 195° F. (43°-91° C.), more preferably from about 130° F. to about 180° F. (48°-82° C.), and most preferably from about 150° F. to about 175° F. (65°-79° C.). This final temperature, also referred to herein as the Freezer Outlet Temperature (FOT), is typically the maximum temperature that will form a smooth plug that holds its shape one extruded onto a moving belt (Step III). It is particularly surprising that some preferred bars can hold their shape on the belt with essentially no cooling (i.e., the initial temperature equals FOT).

Preferably, the molten mixture is as thick as possible while still remaining pumpable. The thick mixture may be obtained by forming a hexagonal liquid crystal phase, also referred to herein as middle phase, in the hot molten mixture. The hexagonal phase and corresponding increase in viscosity is achieved with a synthetic surfactant:water ratio of from about 1:2 to about 2:1, preferably from about 0.75:1 to about 1.5:1, though the exact range for creation of hexagonal phase will vary dependent upon the rest of the composition and the type of synthetic surfactant. Some preferred bars also include a starch, such as corn starch or dextrin, or other thickening polymer to further thicken the molten mixture.

Step III—Extrusion

The cooled mix of Step II is extruded out onto a moving belt as a soft plug which is then cooled and fully crystallized and then stamped and packaged. The plugs are preferably formed via an extrusion operation, as shown in U.S. Pat. No. 3,835,059, supra. In some cases, some of the composition crystallizes in the freezer (Step II) in order to provide a semi-solid having a sufficient viscosity to stand up on the belt, while further crystallization occurs after extrusion, resulting in hardening of the bar. The final crystallization of the free carboxylic acid in these cases forms the interlocking, semi-continuous, open mesh structure in the freezer bar of the present invention.

The plug is preferably cut and stamped at a temperature from about 90° F. to about 130° F. (32°-55° C.) preferably from about 95° F. to about 110° F. (35°-44° C.).

It is a particular advantage of the current invention that extrusion can occur with little or not crystallization in the freezer. In some preferred cases, the viscosity of the mixture in Step I is sufficient such that the mixture can be extruded in Step III with minimal cooling and consequently little or no crystalllization in the freezer. In these preferred cases, virtually all of the free carboxylic acid crystallizes after the mixture is extruded to form the interlocking, semi-continuous, open mesh structure in the freezer bar of the present invention. It is especially surprising that middle phase is useful since it is well known in the art of soap making that creation of middle phase results in an unworkable, unpumpable thick mass and it is highly desirable to avid middle phase. However, it was unexpectedly found that middle phase compositions of the present invention are highly shear thinning, and the apparent viscosity is approximately inversely proportional to shear rate. Thus, the hot molten middle phase mixture in Step I thins with stirring and with pumping to provide good mixing of ingredients and to facilitate transfer of the mixture to the freezer in Step II. However, reduced shear on extrusion of the mixture unexpectedly and surprisingly results in increased viscosity sufficient enough to stand up on the belt as plugs.

Table I summarizes preferred and more preferred viscosity ranges as a function of shear rate for Step I.

TABLE I

| Shear Rate, $sec^{-1}$ | Viscosity Range, cps | |
|---|---|---|
| | Preferred | More Preferred |
| 1 | 100,000-1,000,000 | 100,000-500,000 |
| 5 | 5,000-100,000 | 10,000-65,000 |
| 20 | 1,000-50,000 | 2,500-25,000 |
| 50 | 500-12,000 | 1,000-5,000 |

In the case of tallow and coconut soap combinations well known in the art for processing via the freezer process, the molten mixtures are less shear sensitive and typically a drying step is needed to lower moisture and increase viscosity such that the initially high moisture mixture can be stirred and pumped, while the lower moisture mixture obtained with drying has sufficient viscosity to process through the freezer in Step II. It is a particular advantage of the present invention that drying is not required.

TABLE II

Comparative Freezer Soap Bar Viscosity

| Ingredient | Comparative Examples | |
|---|---|---|
| | Z | AA |
| Sodium Tallowate | 45.6 | 49.4 |
| Sodium Cocoate | 24.5 | 15.6 |
| Free Fatty Acid | 29.5 | 0.1 |
| Sodium Chloride | 0.4 | 0.5 |
| Water | 29.5 | 23.4 |
| Shear Rate, $sec^{-1}$ | 1.3 | 1.0 |

TABLE II-continued

| Comparative Freezer Soap Bar Viscosity | | |
|---|---|---|
| | Comparative Examples | |
| Ingredient | Z | AA |
| Viscosity, cps* | 40,400 | 271,000 |
| Shear Rate, $sec^{-1}$ | 4.0 | 4.0 |
| Viscosity, cps* | 14,800 | 68,100 |
| Shear Rate, $sec^{-1}$ | 18.5 | 18.5 |
| Viscosity, cps* | 4,810 | 37,500 |
| Shear Rate, $sec^{-1}$ | 50.8 | 43.4 |
| Viscosity, cps* | 2,330 | 28,800 |

*88° C. (190° F.)

In the above, the viscosities at various shear rates are shown for a conventional soap-based freezer bar formulation.

Comparative Example Z is before drying, and Comparative Example AA is after drying, as described in the optional Steps. The moisture decreases from 29.5% by weight of the bar in Comparative Example Z to 23.4% in Comparative Example AA.

It is very desirable to have a very high viscosity at low shear in order to minimize the amount of crystallization required to extrude and stand up on the belt. Thus, the low shear viscosity of low moisture (AA), at 271,000 at 1.0 $sec^{-1}$ is very acceptable, but the high moisture (Z) is too thin, at 40,400 cps at 1.3 $sec^{-1}$. On the other hand, it is very desirable to have lower viscosities at high shear to have good stirring and pumpability in Step I. Thus, the higher shear viscosities for the high moisture (Z) (2,330-4,810 cps) are acceptable while those for the low moisture (AA) are too thick (28,800-37,500 cps). As a result, the drying step for Comparative Example Z is necessary to process the formula from Step I through Step III.

TABLE III

| Skin pH Freezer Bars pH 5.5 to 6.0 | | | |
|---|---|---|---|
| | Examples: | | |
| Ingredient | BB Wt. % | CC Wt. % | DD Wt. % |
| 12-Hydroxy Stearic Acid | 16.2 | 14.1 | 14.5 |
| Sodium Cocoyl Isethionate | 44.5 | 38.7 | 38.1 |
| Sodium Linear Alkyl Benzene Sulfonate (LAS) | 1.5 | 1.4 | — |
| Sodium Alkyl Glyceryl Ether Sulfonate (AGS) | 6.2 | 5.4 | 3.1 |
| Sodium Lauroyl Sarcosinate | 4.8 | 4.2 | 4.0 |
| Altowhite Clay | — | — | 3.9 |
| Sodium Chloride | 0.2 | 0.2 | 0.1 |
| Miscellaneous Minors | 3.6 | 3.1 | 2.8 |
| Water | 23.0 | 33.0 | 33.5 |
| Penetration, mm | 11.0 | 9.3 | 7.0 |
| Smear | 5.0 | 8.5 | 9.0 |
| FOT*, °F. | 137 | 138-178 | 146-193 |
| FOT, °C. | 58 | 59-81 | 63-89 |

*Freezer Outlet Temperature

In the above cases, Example CC is produced by adding additional water to the molten mixture of Example BB, resulting in an increase in water level from 23.0% for BB to 33.0% for CC. For these examples, the molten mixture of Step I becomes more viscous with the addition of water (CC). This results in the higher FOT in Step II for CC, with the FOT for BB having a maximum of 137° F. (58° C.), while CC has a maximum FOT of 178° F. (81° C.). Consequently CC is a harder bar relative to BB, 9.3 mm penetration vs. 11.0 penetration; and has improved smear, 8.5 vs 5.0. Example DD shows that further hardness and smear improvements relative to Example CC are achieved by reducing the level of some of the synthetic surfactants (1.4% LAS and 5.4% AGS for CC vs. 0% LAS and 4.0% AGS for DD) and the addition of 3.9% clay in DD.

TABLE IV

| Preferred Skin pH Freezer Bars | | | |
|---|---|---|---|
| | Examples: | | |
| Ingredient | EE Wt. % | FF Wt. % | GG Wt. % |
| 12-Hydroxy Stearic Acid | 14.5 | 18.8 | 14.6 |
| Sodium Lauroyl Isethionate | 34.5 | 32.3 | — |
| Sodium Cocoyl Isethionate | — | — | 34.8 |
| Sodium Alkyl Glyceryl Ether Sulfonate | — | 2.7 | 3.0 |
| Sodium Lauroyl Sarcosinate | 4.0 | 3.6 | 4.0 |
| Coco Betaine | 3.0 | 3.1 | — |
| Altowhite Clay | 4.0 | 3.4 | 4.0 |
| Sodium Chloride | 0.6 | — | 0.1 |
| Fragrance | 0.6 | — | 0.5 |
| Miscellaneous Minors | 4.0 | 5.6 | 6.0 |
| Water | 34.8 | 33.5 | 32.8 |
| pH | 6.0 | — | — |
| Penetration, mm | 7.5 | 9.0 | 7.8 |
| Smear | 8.5 | 8.5 | 9.5 |
| FOT, °F. | 140 | 143-150 | 152 |
| FOT, °C. | 60 | 62-66 | 67 |
| Shear Rate, $sec^{-1}$ | 1 | 1 | 1 |
| Viscosity, cps* | 209,000** | 166,000** | 225,000** |
| Shear Rate, $sec^{-1}$ | 5 | 5 | 5 |
| Viscosity, cps* | 60,700 | 27,200 | 44,000 |
| Shear Rate, $sec^{-1}$ | 20 | 20 | 20 |
| Viscosity, cps* | 21,300 | 4,000 | 12,930 |
| Shear Rate, $sec^{-1}$ | 50 | 50 | 50 |
| Viscosity, cps* | 10,200 | 1,860 | 4,600 |

*At 180° F.
**Extrapolated

In the above cases, Examples EE, FF and GG, shear thinning is demonstrated wherein the molten mixture in Step I has relatively low viscosity at high shear, 1,800-10,200 cps at 50 $sec^{-1}$, sufficient to allow good mixing, and has very high viscosity of low shear, 166,000-225,000 cps at 1 $sec^{-1}$, resulting in extrusion with relatively high FOT (140°-152° F., 60°-67° C.), resulting in bars with good firmness and excellent smear, without requiring a drying step.

What is claimed is:

1. A skin pH freezer bar comprising:

(A) from about 10% to about 50% of essentially free monocarboxylic acid; wherein no more than about 15% by weight of said essentially free monocarboxylic acid is neutralized;

(B) from about 15% to about 65% of anionic and/or nonionic bar firmness aid, said bar firmness aid comprising at least 10% synthetic surfactant by weight of said bar; and (C) from about 15% to about 40% water by weight of said bar; wherein said skin pH is from about 4.8 to about 6.0: wherein said bar firmness aid is selected from the group consisting of:

(I) from about 10% to about 50% by weight of a synthetic surfactant wherein said synthetic surfactant is selected from the group consisting of: alkyl sulfates, paraffin sulfonates, alkyl glyceryl ether sulfonates, anionic acyl sarcosinates, methyl acyl taurates, linear alkyl benzene sulfonates, N-acyl glutamates, alkyl glucosides, alpha sulfo fatty acid esters, acyl isethionates, glucose amide alkyl sulfosuccinates, alkyl ether carboxylates, alkyl phosphate esters, ethoxylated alkyl phosphate esters, methyl glucose esters, protein condensates, the alkyl ether sulfates with 1 to 12 ethoxy groups, and mixtures thereof, wherein said surfactants contain $C_8$–$C_{22}$ alkylene chains; and mixtures thereof; and (II) form zero to about 40% by weight of a co-solvent wherein said co-solvent is selected from the group consisting of:

(a) non-volatile, water-soluble nonionic organic solvents selected from the group consisting of: a polyol of the structure:

$$R_3-O(CH_2-\underset{\underset{R_4}{|}}{CHO})_kH$$

where $R_3$=H, $C_1$–$C_4$ alkyl; $R_4$=H, $CH_3$; and k=1–200; $C_2$–$C_{10}$ alkane diols; sorbitol; glycerine; sugars; sugar derivatives; urea; and wherein said monocarboxylic acid X=H and a+b+-12–20 or said monocarboxylic acid is 12-hydroxy stearic acid; and wherein said water is from about 20% to about 30% by weight of said bar; and (III) mixtures of said (I) and (II); wherein said freezer bar is made by the following process steps:

(I) mixing a molten mixture comprising said essentially free carboxylic acid; said water; and said bar firmness aid at a temperature of 170°–205° F. (76°–96° C.);

(II) cooling said mixture to a semi-solid in a scraped wall heat exchanger freezer at a cooled outlet temperature of 110°–195° F. (43°–91° C.); and (III) extruding said semi-solid as a soft plug; and further cooling and crystallizing said soft plug until firm to provide said skin pH personal cleansing freezer bar; wherein said molten mixture of Step I comprises a liquid crystalline middle phase; said molten mixture has:

a viscosity of from about 100,000 cps to about 1,000,000 cps at a shear rate of about 1 $sec^{-1}$;

wherein said viscosity is from about 5,000 cps to about 100,000 cps at a shear rate of about 5 $sec^{-1}$;

a viscosity of from about 1,000 cps to about 50,000 cps at a shear rate of about 20 $sec^{-1}$;

a viscosity of from about 500 cps to about 12,000 cps at a shear rate of about 50 $sec^{-1}$ and wherein the ratio of synthetic surfactant to water is from about 2:1 to about 1:2; and wherein said freezer bar has a 25° C. penetration value of from zero up to 12 mm; wherein said bar comprises a rigid crystalline phase skeleton structure comprising an interlocking, open, three-dimensional mesh of elongated crystals comprising: (a) said free monocarboxylic acid, or (b) said mixture of said free and neutralized carboxylic acid; wherein said bar also comprises an aqueous phase mix; said mix (when measured alone) having a penetration value of greater than 12 mm to complete penetration at 25° C.

2. The skin pH freezer bar process of claim 1 wherein said bar firmness aid increases said carboxylic acid's solubility in said molten mixture of Step I.

3. The skin pH freezer bar process of claim 1 wherein said molten mixture has a viscosity of from about 100,000 cps to about 500,000 cps at a shear rate of about 1 $sec^{-1}$;

wherein said viscosity is from about 5,000 cps to about 65,000 cps at a shear rate of about 5 $sec^{-1}$;

wherein said viscosity is from about 2,500 cps to about 25,000 cps at a shear rate of about 20 $sec^{-1}$; and wherein said viscosity is from about 1,000 cps to about 5,000 cps at a shear rate of about 50 $sec^{-1}$.

4. The skin pH freezer bar process of claim 1 wherein Step II has a freezer outlet temperature is from about 150°–180° F. (65°–82° C.); and wherein the viscosity obtained in Step I is sufficient that little or no cooling is necessary in Step II in order to extrude said mixture as a soft plug in Step III.

5. The skin pH freezer bar of claim 1 wherein at least 80% of said monocarboxylic acid has the following general formula:

$$H-(CH_2)_a-\underset{\underset{X}{|}}{CH}-(CH_2)_b-CO_2-H$$

wherein:

a+b=10 to 20 each a, b=0 to 20

$$O-\overset{\overset{O}{||}}{C}-R_1,$$

X=H, O-C-$R_1$,

R, or mixtures thereof

R=$C_1$–$C_3$ alkyl, H, or mixtures thereof $R_1$=$C_1$–$C_3$ alkyl.

6. The skin pH freezer bar of claim 1 wherein said bar has a penetration value of less than 12 mm at 49° C. and wherein less than 5% of said monocarboxylic acid (A) is neutralized.

7. The skin pH freezer bar of claim 6 wherein said synthetic surfactant level is from about 20% to about 30% by weight of said bar;

wherein said synthetic surfactant to water has a ratio of from about 2:1 to about 1:2; and wherein said synthetic surfactant is a sodium salt and is selected from the group consisting of: alkyl glyceryl ether sulfonates, acyl isethionates, glucose amides, and mixtures thereof, wherein said surfactants contain $C_{10}$–$C_{18}$ alkylene chains; and mixtures thereof.

8. The skin pH freezer bar of claim 7 wherein said synthetic surfactant is a sodium acyl isethionate and wherein the ratio of said synthetic surfactant to water is from about 1.5:1 to about 0.75:1.

9. The skin pH freezer bar of claim 8 wherein said sodium acyl isethionate is selected from the group consisting of sodium cocoyl isethionate and sodium lauroyl isethionate, and mixtures thereof.

10. The skin pH freezer bar of claim 1 wherein said bar contains from about 0.1% to about 60% of other cleansing bar soap ingredients selected from the group consisting of:

from about 0.5% to about 1% said potassium soap;

from about 0.5% to about 1% triethanolammonium soap;

from about 1% to about 40% of impalpable water-insoluble materials selected from the group consisting of calcium carbonate and talc;

from about 0.1% to about 20% of a polymeric skin feel aid;

from about 0.5% to about 25% of aluminosilicate clay and/or other clays; wherein said aluminosilicates and clays are selected from the group consisting of zeolites; kaolin, kaolinite, montmorillonite, attapulgite, illite, bentonite, halloysite, and calcined clays;

from about 1% to about 40% of salt and salt hydrates; and mixtures thereof; wherein said salt and salt hydrate have a cation selected from the group consisting of: sodium, potassium, magnesium, calcium, aluminum, lithium, ammonium, monoethanol ammonium, diethanolammonium, and triethanolammonium; and wherein said salt and salt hydrate have an anion selected from the group consisting of: chloride, bromide, sulfate, metasilicate, orthophosphate, pyrophosphate, polyphosphate, metaborate, tetraborate, carbonate, bicarbonate, hydrogen phosphate, isethionate, methyl sulfate, and mono- and polycarboxylate of 6 carbon atoms or less;

from about 0.5% to about 30% of a starch;

from about 1% to about 20% of an amphoteric co-surfactant selected from the group consisting of alkyl betaines, alkyl sultaines, and trialkyl amine oxides; and mixtures thereof;

from about 0.1% to about 40% of a hydrophobic material selected from the group consisting of: microcrystalline wax, petrolatum, carnauba wax, palm wax, candelilla wax, sugarcane wax, vegetable derived triglycerides, beeswax, spermaceti, lanolin, wood wax, shellac wax, animal derived triglycerides, montar, paraffin, ozokerite, ceresin, and Fischer-Tropsch wax.

11. The skin pH freezer bar of claim 10 wherein the bar contains a starch at a level of from about 0.5% to about 30% by weight of said bar.

12. The skin pH freezer bar of claim 11 wherein said starch is from about 1% to about 15% by weight of the bar; and wherein said starch is selected from the group consisting of corn starch and dextrin.

* * * * *